US010390130B2

(12) United States Patent
Nakadai et al.

(10) Patent No.: US 10,390,130 B2
(45) Date of Patent: Aug. 20, 2019

(54) SOUND PROCESSING APPARATUS AND SOUND PROCESSING METHOD

(71) Applicant: HONDA MOTOR CO., LTD., Tokyo (JP)

(72) Inventors: Kazuhiro Nakadai, Wako (JP); Ryosuke Kojima, Kyoto (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 15/619,865

(22) Filed: Jun. 12, 2017

(65) Prior Publication Data

US 2018/0070170 A1 Mar. 8, 2018

(30) Foreign Application Priority Data

Sep. 5, 2016 (JP) ..... 2016-172985

(51) Int. Cl.
*H04R 25/00* (2006.01)
*H04R 1/40* (2006.01)
*H04R 3/00* (2006.01)

(52) U.S. Cl.
CPC ..... *H04R 1/406* (2013.01); *H04R 3/005* (2013.01); *H04R 2201/401* (2013.01)

(58) Field of Classification Search
CPC ... H04R 1/406; H04R 3/005; H04R 2201/401
USPC ..... 381/71.8, 92, 356, 21; 704/256.7
See application file for complete search history.

(56) References Cited

U.S. PATENT DOCUMENTS

2007/0033045 A1* 2/2007 Smaragdis ..... G10L 21/028 704/256.7
2009/0323977 A1* 12/2009 Kobayashi ..... H04R 1/406 381/71.8
2015/0312678 A1* 10/2015 Kruger ..... H04H 20/89 381/303
2015/0373471 A1* 12/2015 Krueger ..... G10L 19/008 381/21
2016/0015023 A1* 1/2016 Byerly ..... A01M 31/002 381/333

FOREIGN PATENT DOCUMENTS

JP 4157581 7/2008

* cited by examiner

*Primary Examiner* — Phylesha Dabney
(74) *Attorney, Agent, or Firm* — Rankin, Hill & Clark LLP

(57) ABSTRACT

A sound processing apparatus includes an acquisition unit configured to acquire sound signals collected by a microphone array, a sound source localization unit configured to determine a sound source direction on the basis of the sound signals acquired by the acquisition unit, and a sound source identification unit configured to identify a type of sound source on the basis of a sound model indicating a dependence relationship between sound sources, in which the sound model is represented by a probabilistic model expression including sound source localization as an element.

3 Claims, 8 Drawing Sheets

SOUND PROCESSING APPARATUS AND SOUND PROCESSING METHOD

CROSS-REFERENCE TO RELATED APPLICATION

This application claims priority based on Japanese Patent Application No. 2016-172985 filed in Japan on Sep. 5, 2016, the entire content of which is incorporated herein by reference.

BACKGROUND OF THE INVENTION

Field of the Invention

The present invention relates to a sound processing apparatus and a sound processing method.

Description of Related Art

In order to understand an environment, acquiring information on a sound environment is an important element and is expected to be applied to robots, vehicles, home appliances, and the like. In order to acquire the information on the sound environment, an underlying technology such as sound source localization, sound source separation, sound source identification, speech section detection, voice recognition, or the like is used. In general, various sound sources are located at different positions in the sound environment. A sound collecting unit such as a microphone array or the like is used at a sound collection point to acquire the information on the sound environment. The sound collecting unit acquires a sound signal of a mixed sound obtained by mixing sound signals from each sound source.

In the related art, sound source localization is performed on collected sound signals to perform sound source identification on a mixed sound, sound source separation is performed on the sound signals on the basis of the direction of each sound source, and thereby sound signals for each sound source are acquired as a result of the processing.

For example, in a technology described in Japanese Patent No. 4157581 (hereinafter, Patent Document 1), a microphone collects sound signals and a sound source localization unit estimates the direction of the sound source. Then, a sound source separation unit separates a sound source signal from the sound signals using information on the direction of the sound source estimated by the sound source localization unit in the technology described in Patent Document 1.

When the sound signals are, for example, calls of wild birds, collecting sounds is performed in the outdoors within a forest. In sound source separation processing in which sound signals collected in such an environment are used, there are some cases in which a sound source cannot be sufficiently separated due to an influence of obstacles such as trees, topography, or the like. FIG. 10 is a diagram which shows an example of a result of sound source separation between calls of a Japanese white-eye and a brown-eared bulbul which are singing nearby at the same time according to the related art. In FIG. 10, the horizontal axis represents time and the vertical axis represents frequency. An image of a region surrounded by a dashed line g901 is a spectrograph of separated sounds of a Japanese white-eye. An image of a region surrounded by a dashed line g911 is a spectrograph of separated sounds of a brown-eared bulbul. As in a region surrounded by a dashed line g902 and a region surrounded by a dashed line g912 in FIG. 10, the call of a Japanese white-eye may leak into the separated sounds of a brown-eared bulbul. In addition, there are some cases in which sounds and the like generated by wind are mixed into the separated sounds in separation processing. In this manner, when sound sources are close to each other, other sound signals may be mixed into separated sound signals.

SUMMARY OF THE INVENTION

However, in the technology described in Patent Document 1, although when sound sources are close to each other, there is a high likelihood that these sound sources are the same sound source, it has not been possible to effectively use information for sound source identification in a method of the related art.

Aspects according to the present invention are made in view of the problems described above, and an object thereof is to provide a sound processing apparatus and a sound processing method which can perform sound source identification with high accuracy by effectively using information on proximity between sound sources.

In order to achieve the above-described object, the present invention adopts the following aspects.

(1) A sound processing apparatus according to one aspect of the present invention includes an acquisition unit configured to acquire sound signals collected by a microphone array, a sound source localization unit configured to determine a sound source direction on the basis of the sound signals acquired by the acquisition unit, and a sound source identification unit configured to identify a type of sound source on the basis of a sound model indicating a dependence relationship between sound sources, in which the sound model is represented by a probabilistic model expression including sound source localization as an element.

(2) In the above aspect (1), the sound model may be modeled for each class based on a feature amount of the sound source in the probabilistic model expression.

(3) In the above aspect (1) or (2), the sound source identification unit may determine that a plurality of the sound sources having the same class are in directions close to each other and determine that a plurality of the sound sources having different classes are in directions distant from each other based on the feature amount of the sound source.

(4) In one of the above aspects (1) to (3), the sound source localization unit may further include a sound source separation unit configured to separate sound sources on the basis of a result of a sound source direction determined by the sound source localization unit, in which the sound model may be made based on a result of the separation by the sound source separation unit.

(5) A sound processing method according to one aspect of the present invention includes an acquisition procedure of acquiring, by an acquisition unit, a sound signal collected by a microphone array, a sound source localization procedure of determining, by a sound source localization unit, a sound source direction on the basis of a sound signal acquired in the acquisition procedure, and a sound source identification procedure of identifying a type of sound source on the basis of a sound model indicating a dependence relationship between sound sources, in which the sound model is represented by a probabilistic model expression including sound source localization as an element.

In the aspect (1) or (5), it is possible to directly use a result of sound source localization for sound source identification, and furthermore to perform sound source identification on the basis of a sound model of a probabilistic model expression indicating a dependence relationship between sound sources. As a result, according to the aspect (1) or (5), it is possible to effectively utilize the dependence relationship between sound sources by using a sound model of a probabilistic model expression. Then, according to the aspect (1) or (5), since information on proximity between sound sources can be effectively used to perform sound source identification using the sound model of a probabilistic model expression, it is possible to perform sound source identification with high accuracy. The information on proximity between sound sources is information representing that sound sources are close to each other and sound sources are the same. In addition, the probabilistic model expression is a graphical model, and is, for example, Bayesian network expression.

Moreover, in a case of (2), it is possible to improve the accuracy of sound source identification by using the feature amount of the sound model.

Moreover, in a case of (3), a probability of the sound model of the probabilistic model expression is set according to a degree of proximity and the type of sound source. When sound sources are close to each other, a dependence relationship occurs between the sound sources, and thus it is possible to improve the accuracy of sound source identification.

Furthermore, in a case of (4), since a result of separation performed by a sound source separation unit is used to make a sound model, it is possible to improve the accuracy of sound source identification.

DETAILED DESCRIPTION OF THE INVENTION

Figure 1:
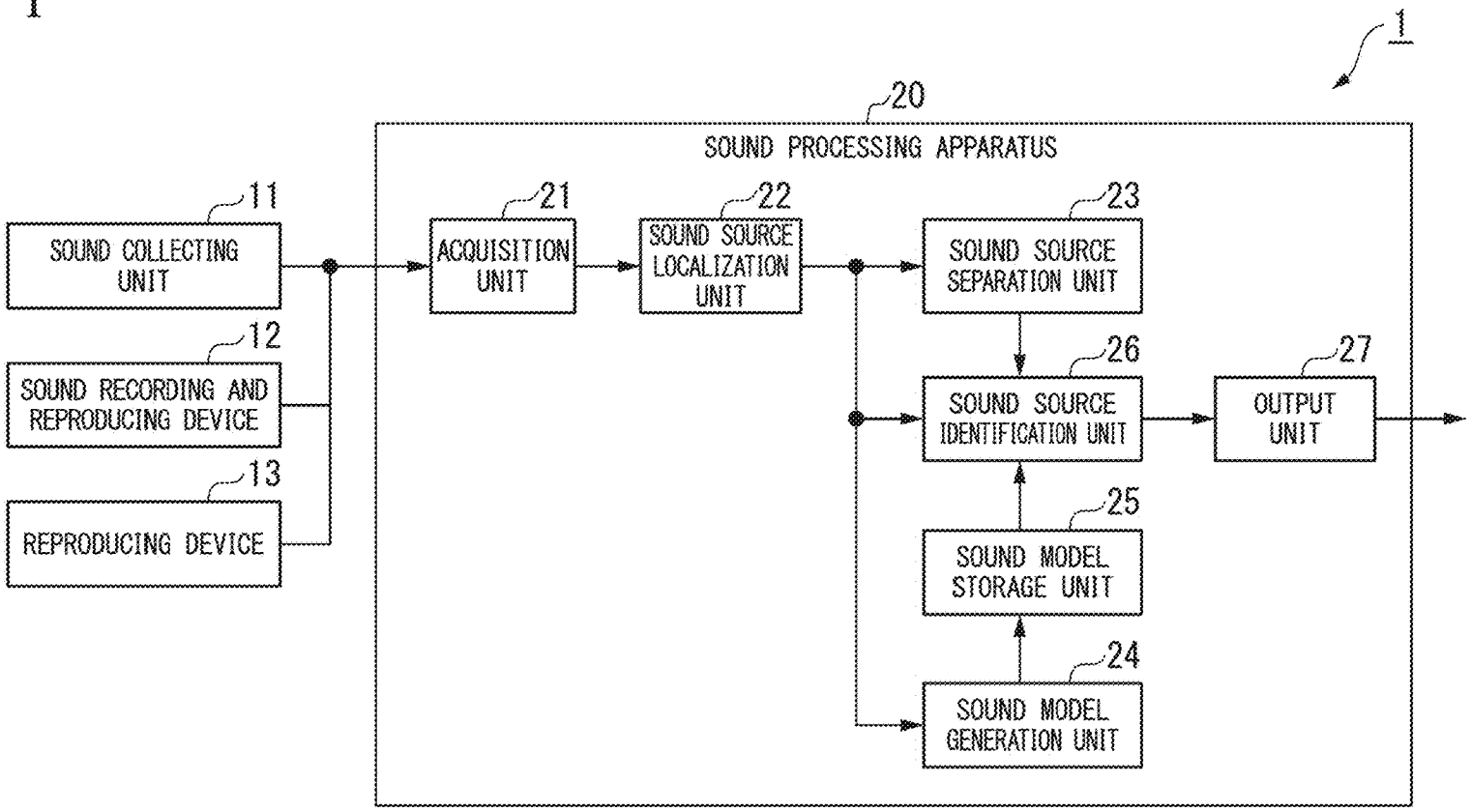
FIG. 1 is a block diagram which shows a configuration of a sound signal processing system according to a first embodiment.

Hereinafter, embodiments of the present invention will be described referring to the drawings.

First Embodiment

In a first embodiment, an example in which a sound signal is a sound signal obtained by collecting calls of wild birds will be described.

FIG. 1 is a block diagram which shows a configuration of a sound signal processing system 1 according to the present embodiment. As shown in FIG. 1, the sound signal processing system 1 includes a sound collecting unit 11, a sound recording and reproducing device 12, a reproducing device 13, and a sound processing apparatus 20. In addition, the sound processing apparatus 20 includes an acquisition unit 21, a sound source localization unit 22, a sound source separation unit 23, a sound model generation unit 24, a sound model storage unit 25, a sound source identification unit 26, and an output unit 27.

The sound collecting unit 11 collects sounds arriving at the unit itself and generates sound signals of P channels (P is an integer equal to or greater than two) from the collected sounds. The sound collecting unit 11 is a microphone array, and has P microphones disposed at different positions. The sound collecting unit 11 outputs the generated sound signals of P channels to the sound processing apparatus 20. The sound collecting unit 11 may include a data input/output interface for transmitting the sound signals of P channels wirelessly or by cable.

The sound recording and reproducing device 12 records sound signals of P channels and outputs the recorded sound signals of P channels to the sound processing apparatus 20.

The reproducing device 13 outputs sound signals of P channels to the sound processing apparatus 20.

The sound signal processing system 1 may include at least one of the sound collecting unit 11, the sound recording and reproducing device 12, and the reproducing device 13.

The sound processing apparatus 20 estimates a sound sourced direction from the sound signals of P channels output by one of the sound collecting unit 11, the sound recording and reproducing device 12, and the reproducing device 13, and separates the sound signals into sound signals by sound source which represent components from each sound source. In addition, the sound processing apparatus 20 determines sound source types of the sound signals by sound source on the basis of the estimated sound source direction using a sound model which shows a relationship between a sound source direction and a sound source type. The sound processing apparatus 20 outputs information on a sound source type which indicates the determined sound source type.

The acquisition unit 21 acquires sound signals of P channels output by one of the sound collecting unit 11, the sound recording and reproducing device 12, and the reproducing device 13, and outputs the acquired sound signals of P channels to the sound source localization unit 22. When the acquired sound signals are analog signals, the acquisition unit 21 converts the analog signals into digital signals and outputs the sound signals converted into digital signals to the sound source localization unit 22.

The sound source localization unit 22 determines (sound source localization) each sound source direction for each frame with a predetermined length (for example, 20 ms) on the basis of the sound signals of P channels output by the acquisition unit 21. The sound source localization unit 22 calculates a spatial spectrum which indicates a power of each direction using, for example, a Multiple Signal Classification (MUSIC) method in the sound source localization. The sound source localization unit 22 determines a sound source direction for each sound source on the basis of the spatial spectrum. The number of sound sources determined at this time may be one or more. In the following description, a $k_t^{th}$ sound source direction in a frame at a time t is represented as $d_{kt}$, and the detected number of sound sources is represented as $K_t$. When sound source identification is performed, the sound source localization unit 22 outputs the information on a sound source direction which indicates the determined sound source direction for each sound source to the sound source separation unit 23 and the sound source identification unit 26. The information on a sound source direction is information which represents a direction [d] of each sound source (=[$d_1$, $d_2$, . . . , $d_{kt}$, . . . , $d_{Kt}$]; $0 \le d_{kt} < 2\pi$, $1 \le k_t \le K_t$). When sound source identification is performed, the sound source localization unit 22 outputs the sound signals of P channels to the sound source separation unit 23. In addition, when a sound model is generated, the sound source localization unit 22 outputs information indicating the obtained number of sound sources and information indicating a localized sound source direction to the sound model generation unit 24. A specific example of the sound source localization will be described below.

The sound source separation unit 23 acquires the information on a sound source direction and the sound signals of P channels output from the sound source localization unit 22. The sound source separation unit 23 separates the sound signals of P channels into sound signals by sound source which are sound signals indicating components for each sound source on the basis of a sound source direction indicated by the information on a sound source direction. When the separation into sound signals by sound source is performed, the sound source separation unit 23 uses, for example, a Geometric-constrained High-order Decorrelation-based Source Separation (GHDSS) method. Hereinafter, a sound signal by sound source of a sound source $k_t$ in a frame at a time t is represented as $S_{kt}$. When sound source identification is performed, the sound source separation unit 23 outputs the separated sound signals by sound source for each sound source to the sound source identification unit 26. There are K sound signals by sound source output by the sound source separation unit 23 if the number of sound sources is K.

The sound model generation unit 24 generates (learns) model data on the basis of the sound signals by sound source for each sound source, a sound source class and a subclass belonging to the sound source class, and a sound source direction. The sound source class and the subclass will be described below. The sound model generation unit 24 may use sound signals by sound source separated by the sound source separation unit 23, and may also use sound signals by sound source acquired in advance. The sound model generation unit 24 stores data of a generated sound model in the sound model storage unit 25.

Data generation processing of a sound model will be described below.

The sound model storage unit 25 stores a sound source model generated by the sound model generation unit 24.

The sound source identification unit 26 calculates a sound feature amount of the sound signals by sound source output by the sound source separation unit 23 using, for example, the GHDSS method. The sound source identification unit 26 estimates a sound source class and a subclass for the sound signals by sound source output by the sound source separation unit 23. The sound source identification unit 26 estimates a sound source class of the sound signals by sound source output by the sound source separation unit 23 using a calculated sound feature amount, information indicating a sound source direction output by the sound source localization unit 22, a sound source class and a subclass which have been estimated, and a sound source model, a subclass, and a sound model which are stored in the sound model storage unit 25. The sound source identification unit 26 outputs information indicating an estimated sound source class to the output unit 27 as information on a sound source type.

A calculation method of a sound feature amount and sound source identification processing will be described below.

The output unit 27 outputs the information on a sound source type which is output by the sound source identification unit 26 to an external device. The external device is, for example, an image display device, a computer, a voice reproduction device, and the like. The output unit 27 may output the sound source signals by sound source and the information on a sound source direction in association with information on a sound source type for each sound source.

In addition, the output unit 27 may include an input/output interface for outputting various types of information to other devices, and may also include a storage medium which stores these types of information. Moreover, the output unit 27 may also include an image display unit (a display and the like) which displays these types of information.

Here, the call of birds will be described. The call of birds has two types, which are a song and a natural voice. The song is also called twitter and is known as a medium for communication with special meanings such as territorial claims, appeals to the other sex in a breeding period, and the like. The natural voice is also called a call, and is generally a simple call such as "chi" or "ja". For example, in a case of "bush warbler", the song is "hohokekyo", and the natural voice is "titching".

Figure 2:
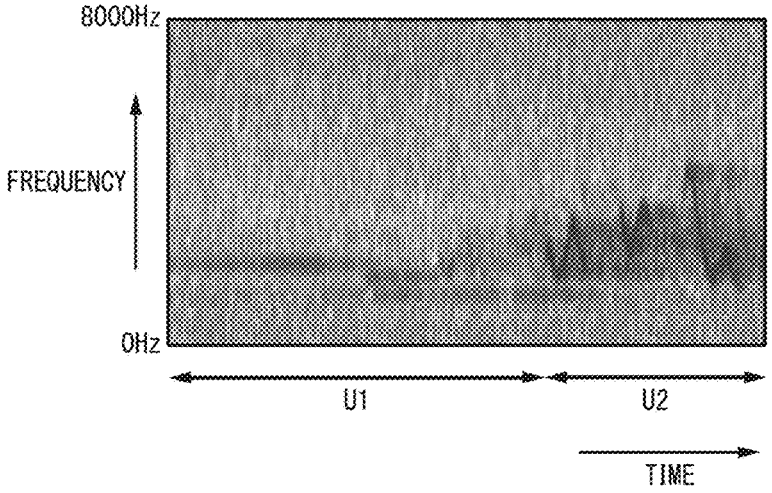
FIG. 2 is a diagram which shows a spectrogram of the call "hohokekyo" of a bush warbler for one second.

FIG. 2 is a diagram which shows a spectrogram of a call "hohokekyo" of a bush warbler for one second. In FIG. 2, a horizontal axis represents time and a vertical axis represents frequency. The shading represents a magnitude of power for each frequency. A darker portion indicates more power and a lighter portion indicates less power. A section U1 is a subclass portion corresponding to "hoho". A section U2 is a subclass portion corresponding to "kekyo". In the section U1, a frequency spectrum has shallow peaks, and a time change of a peak frequency is gentle. On the other hand, the frequency spectrum has sharp peaks and a time change of a peak frequency is more considerable in the section U2.

Next, a sound source class and a subclass in the present embodiment will be described.

The sound source class is obtained by classifying one sound section according to sound features, and is a classification according to, for example, the type of bird, a bird individual, or the like. The sound section is a time in which sounds with a magnitude, for example, equal to or more than a predetermined threshold value are continuous among sound signals. The sound model generation unit 24 classifies into sound source classes by performing clustering on the basis of, for example, a sound feature amount. In addition, a subclass is a sound section shorter than a sound source class and is a configuration unit of a sound source class. The subclass corresponds to, for example, a phoneme of speech uttered by a human being.

For example, in a case of a bush warbler, the bush warbler is a sound source class, and a section U1 and a section U2 (FIG. 2) are subclasses. In this manner, in a song that is a bird's call, a sound source class includes one or a plurality of subclasses.

In the present embodiment, the following numerals are used in the following description. K(={1, . . . , k, . . . , K}) is the maximum number of detectable sound sources (hereinafter, also referred to as the number of sound sources), and is a natural number equal to one or more. C(={$c_1$, . . . , $c_K$}) is the type of sound source, and is a set of sound source classes. $c(=\{s_{c1}, \ldots, s_{cj}\})$ is a sound source class. $s_{c1}$ is a first subclass of the sound source class c. $s_{cj}$ is a $j^{th}$ subclass of the sound source class c.

Next, the MUSIC method which is one method for sound source localization will be described.

The MUSIC method is a method of determining a direction φ in which a power $P_{ext}(\varphi)$ of a spatial spectrum described below is a maximum and is even higher than a predetermined level as a sound source direction. A storage unit included in the sound source localization unit 22 stores a transfer function for each of sound source directions φ distributed at predetermined intervals (for example, 5°). The sound source localization unit 22 generates a transfer function vector [D(φ)] having a transfer function $D[_p](\omega)$ from a sound source to a microphone corresponding to each channel p (p is an integer from one to P) as an element in each sound source direction φ.

The sound source localization unit 22 calculates a transformation coefficient $x_p(\omega)$ by transforming a sound signal $x_p$ of each channel p into a frequency region for each frame made of a predetermined number of samples. The sound source localization unit 22 calculates an input correlation matrix $[R_{xx}]$ shown in the following Equation (1) from an input vector [x(ω)] including the calculated transformation coefficient as an element.

$$[R_{xx}]=E[[x(\omega)][x(\omega)]^*] \tag{1}$$

In Equation (1), E[Y] indicates an expected value of Y. [Y] indicates that Y is a matrix or a vector. [Y]* indicates a conjugate transpose of a matrix or a vector.

The sound source localization unit 22 calculates an eigenvalue $\delta_i$ and an eigevector $[e_i]$ of the input correlation matrix $[R_{xx}]$. The input correlation matrix $[R_{xx}]$, the eigenvalue $\delta_i$, and the eigevector $[e_i]$ have a relationship shown in the following Equation (2).

$$[R_{xx}][e_i]=\delta_i[e_i] \tag{2}$$

In Equation (2), i is an integer from one to P. An order of indices i is a descending order of the eigenvalues $\delta_i$.

The sound source localization unit 22 calculates a power $P_{sp}(\varphi)$ of a spatial spectrum by frequency shown in the following Equation (3) on the basis of the transfer function vector [D(φ)] and the calculated eigenvector $[e_i]$.

$$P_{sp}(\varphi) = \frac{|[D(\varphi)]^*[D(\varphi)]|}{\sum_{i=K+1}^{P} |[D(\varphi)]^*[e_i]|} \tag{3}$$

In Equation 3, K is a pre-set natural number which is smaller than P.

The sound source localization unit 22 calculates a sum of spatial spectrums $P_{sp}(\varphi)$ in a frequency band in which an SN ratio (signal-to-noise ratio) is greater than a predetermined threshold value (for example, 20 dB) as the power $P_{ext}(\varphi)$ of a spatial spectrum in an entire band.

The sound source localization unit 22 may calculate a sound source position using other methods instead of the MUSIC method. The sound source localization unit 22 may calculate a sound source position using, for example, a Weighted Delay and Sum Beam Forming (WDS-BF) method.

Next, the GHDSS method which is one method for sound source separation will be described.

The GHDSS method is a method of adaptively calculating a separation matrix [V(ω)] so that a separation sharpness $J_{SS}([V(\omega)])$ and a geometric constraint $J_{GC}([V(\omega)])$ as two cost functions are reduced, respectively. The separation matrix [V(ω)] is a matrix used to calculate a voice signal by sound source (estimated value vector) [u'(ω)] of each of the maximum number of detected sound sources K by being multiplied by a voice signal [x(ω)] of P channels output by the sound source localization unit 22. Here, $[Y]^T$ indicates a transpose of a matrix or a vector.

The separation sharpness $J_{SS}([V(\omega)])$ and the geometric constraint $J_{GC}([V(\omega)])$ are represented as shown in Equations (4) and (5), respectively.

$$J_{SS}([V(\omega)])=\|\varphi([u'(\omega)])[u'(\omega)]-\mathrm{diag}[\varphi([u'(\omega)])[u'(\omega)]^*]\|^2 \tag{4}$$

$$J_{GC}([V(\omega)])=\|\mathrm{diag}\ [[V(\omega)][D(\omega)]-[I]]\|^2 \tag{5}$$

In Equations (4) and (5), $\|Y\|^2$ is a Frobenius norm of a matrix Y. The Frobenius norm is a sum of squares (scalar value) of element values configuring a matrix. φ([u'(ω)]) is a non-linear function of a voice signal [u'(ω)], for example, a hyperbolic tangent function. diag[Y] indicates a sum of diagonal elements of the matrix Y. Therefore, the separation sharpness $J_{SS}([V(\omega)])$ is a magnitude of a non-diagonal component between channels of the spectrum of a voice signal (estimated value), that is, an index value which represents a degree to which one sound source is erroneously separated as another sound source. In addition, [I] in Equation (5) indicates a unit matrix. Accordingly, the geometric constraint $J_{GC}([V(\omega)])$ is an index value which represents a degree of error between the spectrum of a voice signal (estimated value) and a spectrum of a voice signal (sound source).

Next, a sound model used in sound source identification will be described.

When the type of the sound source is the call of birds, and the sound source class thereof has a plurality of subclasses, it is assumed that sounds from the sound source at each time is probabilistically selected among a plurality of sound source classes and a plurality of subclasses. In the case of a bush warbler song "hohokekyo" described above, it is assumed that different frequency spectra of each of a first subclass "hoho" and a second subclass "kekyo" are probabilistically selected. Accordingly, a sound model used in sound source identification in the present embodiment is generated as a model obtained by mixing different spectra. Furthermore, the sound model in the present embodiment is configured by two distributions of a probability distribution related to a separated sound and a probability distribution related to an incoming direction. For the distribution related to a separated sound, a Gaussian Mixture Model (GMM) is used. For the distribution related to an incoming direction, a von Mises distribution is used. In other words, a GMM is extended and used to consider a sound source position in the present embodiment.

First, a GMM will be described.

In a sound model using a GMM, it is assumed that one sound source class has a plurality of subclasses. In addition, it is assumed that a sound signal from a sound source at each of times is probabilistically selected from the plurality of subclasses in the sound model using a GMM. Moreover, it is assumed that a sound feature amount calculated from a frequency spectrum is in accordance with a multivariate Gaussian distribution in the sound model using a GMM.

Accordingly, even one sound source class can express frequency spectrum patterns of a number of subclasses in the sound model using a GMM. As a result, modeling can be performed even on a sound signal in which signals having different spectra are mixed in the sound model using a GMM.

Statistical properties of a subclass can be expressed using, for example, a multivariate Gaussian distribution, as a predetermined statistical distribution. When a sound feature amount x is given, a probability $p(x,s_{cj},c)$ whose subclass is a $j^{th}$ subclass $s_{cj}$ of a sound source class C can be expressed by the following Equation (6). The sound feature amount x is a vector.

$$p(x,s_{cj},c)=N_{cj}(x)p(s_{cj}|C=c)p(C=c) \tag{6}$$

In Equation (6), $N_{cj}(x)$ indicates that a probability distribution $p(x|s_{cj})$ of the sound feature amount x related to a subclass $s_{cj}$ is a multivariate Gaussian distribution. $P(s_{cj}|C=c)$ indicates a conditional probability of taking a subclass $s_{cj}$ when the sound source type C is a sound source class c. Accordingly, a sum $\Sigma_j p(s_{cj}|C=c)$ of the conditional probabilities of taking the subclass $s_{cj}$ on condition that the sound source type C is the sound source class c is one. P(C=c) indicates a probability that the sound source type C is c. p(•|•) is a conditional probability. In the example described above, a subclass includes a probability p(C=c) for each sound source type, a conditional probability $p(s_{cj}|C=c)$ for each subclass $s_{cj}$ when the sound source type C is the sound source class c, and a mean value of the multivariate Gaussian distribution related to the subclass $s_{cj}$, and a covariance matrix. The sound source identification unit 26 uses a subclass when the sound feature amount x is given, and when the subclass $s_{cj}$ or the sound source class c including the subclass $s_{cj}$ is determined.

In the sound model using a GMM, a GMM which is a sound model is constructed by setting the sound source type C as a random variable, or setting the sound source type C as a fixed value in a case of annotated data, for example, by performing semi-supervised learning using an Expectation Maximization (EM) algorithm. Annotation is association. In the present embodiment, association between a sound source type and a sound unit for each section with respect to a previously acquired sound signal by sound source is called annotation.

In the sound model using a GMM, identification of a sound source is performed by performing Maximum A Postriori (MAP) estimation using the following Equation (7) after a sound model is constructed. In Equation (7), $C_k$ indicates a sound source class of a sound source k.

$$c^* = \underset{c}{\operatorname{argmax}} p(C_k = c \mid x) \tag{7}$$

Next, a sound model used in the present embodiment will be described.

In the sound model using a GMM described above, modeling is performed independently on each separated sound. For this reason, each time t and each separated sound kt at time t is independently modeled. In the sound model using a GMM, learning is performed independently on each separated sound, and thus it is not possible to reflect a sound source position in a sound model. Accordingly, in the sound model using a GMM, it is not possible to consider leakage between separated sounds dependent on a positional relationship between sound sources. Therefore, in the sound model of the present embodiment, the GMM is extended in consideration of dependency between each separated sound.

Here, a Bayesian network expression used in the sound model of the present embodiment will be described. A Bayesian network is one of probability models which describes a cause and effect relationship (dependence relationship) according to a probability and has a graph structure. That is, in the present embodiment, the Bayesian network is used in a sound model in this manner, and thereby it is possible to include a dependence relationship between sound sources in the sound model.

Figure 3:
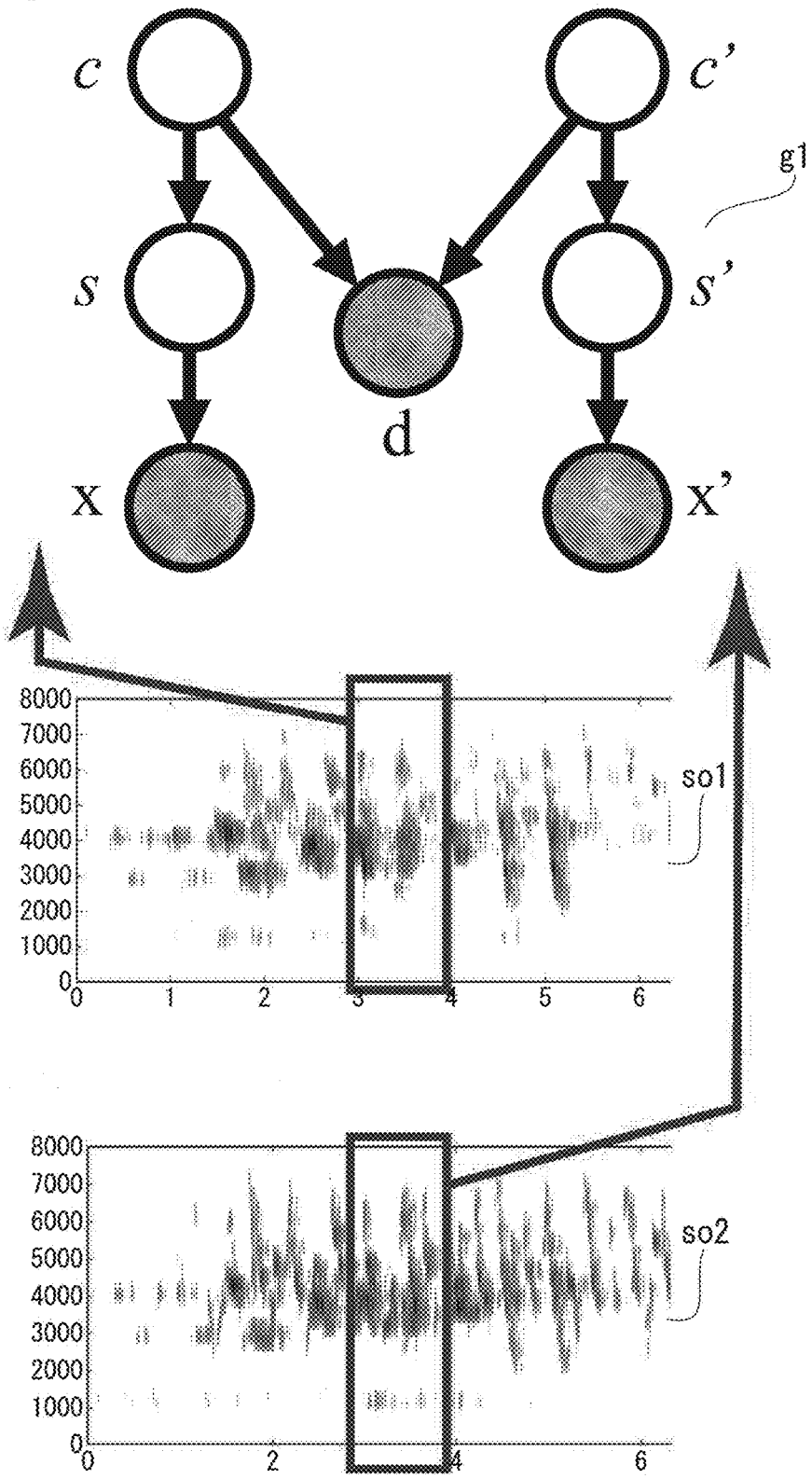
FIG. 3 is a diagram for describing an example of Bayesian network expression of a sound model according to the first embodiment.

FIG. 3 is a diagram for describing an example of Bayesian network expression of a sound model according to the present embodiment. In FIG. 3, a diagram indicated by a reference numeral g1 is a diagram indicating an example of a Bayesian network expression. An image so1 is a spectrogram of a first separated sound. An image so2 is a spectrogram of a second separated sound. In the image so1 and the image so2, a horizontal axis represents time and a vertical axis represents frequency. An example shown in FIG. 3 is an example in which incoming directions of two sound sources are close to each other, that is, sound source directions of both are d. A direction d ($=d_{t,1}, d_{t,2}, \ldots, d_{t,kt}, \ldots, d_{t,Kt}$, where $0 \le d_{t,kt} < 2\pi$, $1 \le k_t \le K_t$) of a sound source $k_t$ of a time t is estimated by the sound source localization unit 22 using the MUSIC method. Then, the sound source localization unit 22 estimates the number of sound sources $K_t$ using a predetermined threshold value as a power obtained by the MUSIC method. In addition, a sound feature amount $x_{kt}$ of each separated sound is calculated by the sound source identification unit 26 using a method such as GHDSS as described below.

In FIG. 3, the first separated sound and the second separated sound are different separated sounds whose directions at the same time are close to each other. Specifically, the first separated sound leaks into the second separated sound at a time t. Therefore, the first separated sound is mixed into the second separated sound.

An observation variable x is a sound feature amount of the first separated sound. An observation variable x' is a sound feature amount of the second separated sound. An observation variable s is a subclass of the first separated sound at the time t. An observation variable s' is a subclass of the second separated sound at the time t. An observation variable c is a sound source class of the first separated sound at the time t. An observation variable c' is a sound source class of the second separated sound at the time t. An observation variable d is a vector of incoming directions of separated sounds.

The Bayesian network shown in FIG. 3 can be described as shown in the following Equation 8.

$$p(x, d, s, c) = p(d \mid c)\prod_{k=1}^{K} N_{s_{c_k}}(x_k)p(s_{c_k} \mid c_k)p(c_k) \tag{8}$$

Equation (8) represents a probability that a direction in which a bird's sound exists is d when the number of separated sounds is K. In Equation (8), $s_{ck}$ is a $k^{th}$ subclass of the sound source class c. In addition, p(d|c) in Equation (8) is divided into two cases in which two sound sources have the same sound source class ($c_i=c_j$) and in which two sound sources have different sound source classes ($c_i \ne c_j$), and can be represented as shown in the following Equation (9) and Equation (10). Each of $c_i$ and $c_j$ is a sound source class.

$$p(d \mid c) = \prod_{c_i=c_j, i\ne j} p(d_i, d_j \mid c_i = c_j) \tag{9}$$

$$p(d \mid c) = \prod_{c_i\ne c_j, i=j} p(d_i, d_j \mid c_i \ne c_j) \tag{10}$$

In Equation (9) and Equation (10), each of $d_i$ and $d_j$ is a sound source direction. Here, when the number of separated sounds K is two, $p(d_i,d_j|c_i=c_j)$ in Equation (9) is expressed by the following Equation (11). In equation (10), $p(d_i, d_j|c_i\neq c_j)$ is expressed by the following Equation (12).

$$p(d_i,d_j|c_i=c_j)=f(d_i-d_j;\kappa_1) \tag{11}$$

$$p(d_i,d_j|c_i\neq c_j)=f(d_i-d_j+\pi;\kappa_2) \tag{12}$$

In Equation (12), since the number of separated sounds K is two, $\pi$ of the right side represents that sound source directions are opposite (+180°). In addition, in Equation (11) and Equation (12), f(d;k) is a von Mises distribution and is expressed by the following Equation (13). $\kappa$ is a parameter representing a concentration degree of a distribution and is a value equal to zero or more.

$$f(d_i;\kappa)=\frac{\exp(\kappa\cos(d))}{2\pi I_0(\kappa)} \tag{13}$$

$I_o(\kappa)$ in Equation (13) is a $0^{th}$ order modified Bessel function.

Here, a reason for using the von Mises distribution in the present embodiment will be described. The von Mises distribution is a continuous type of probability distribution defined on a circumference. It is assumed that a sound source direction is on the circumference. For this reason, the von Mises distribution defined on the circumference is used as a distribution of directions in the present embodiment.

In Equation (11), if $p(d_i,d_j|c_i=c_j)$ is paid attention to, this represents that a probability value has a high value when positions of two sound sources are close to each other and the two sound sources belong to the same sound source class. On the other hand, in Equation (12), if $p(d_i,d_j|c_i=c_j)$ is paid attention to, this represents that a probability value has a high value when positions of two sound sources are distant from each other and the two sound sources belong to different classes. "Close" represents that, when there are two sound sources, a direction $d_i$ and a direction $d_j$ of each of the two sound sources are substantially the same. Moreover, "distant" represents that, when there are two sound sources, the direction $d_i$ and the direction $d_j$ of each of the two sound sources are separated by an angle $\pi$.

In the present embodiment, in order to consider a case in which there are two or more sound sources at the same time ($K_t$>2), a probability value p(d|c) is defined by combination between all sound sources as shown in Equation (9) and Equation (10). Equation (8) to Equation (13) described above express a sound model. Then, as shown in FIG. 3 and Equations (8) to (13), a sound model is modeled for each sound source class.

When a sound source class is estimated using this sound model, it is necessary to note that sound sources classes $c_i$ and $c_j$ are not independent. In other words, as described in a GMM, since each sound feature amount is not independent, it is necessary to consider a sound source class of other sound sources at the same time when a sound source class of a certain sound source is determined. Therefore, in order to estimate a sound source class in the present embodiment, Equation (7) of a sound model using a GMM is extended as in Equation (14). The sound source identification unit 26 estimates a sound source class using Equation (7).

$$\begin{aligned} c^* &= \underset{c}{\operatorname{argmax}}\, p(c\mid x, d) \\ &= \underset{c}{\operatorname{argmax}}\, p(x\mid c)p(d\mid c)p(c) \end{aligned} \tag{14}$$

Next, a method of learning parameters of the sound model in the present embodiment will be described.

In the present embodiment, semi-supervised learning in an EM algorithm is performed in consideration of mutual dependency between separated sounds.

The sound model generation unit 24 generates a sound model by performing semi-supervised learning in which annotation is performed in advance on some of sounds separated with respect to sound signals acquired in advance, and stores the generated sound model in the sound model storage unit 25.

When a sound source class c corresponding to the sound feature amount x is given, that is, in a case of supervised learning, it is possible to calculate the sound source class c independently from another sound source class c' due to characteristics of the Bayesian network as shown in FIG. 3. Accordingly, in the case of supervised learning, it is possible to perform the same learning as conventional parameter learning of a sound model using a GMM.

However, in a case of partial annotation, that is, when semi-supervised learning is performed, the sound source class c and the sound source class c' are not independent. Therefore, it is not possible to perform learning independently on each sound feature amount x.

Hereinafter, a case in which the sound source class c and the sound source class c' are not annotated will be described.

In an EM algorithm, it is necessary to calculate an expected value of an appearance probability of a subclass s in a data set. An expected value $N_s$ can be expressed as shown in the following Equation (15).

$$N_s=\sum_t\sum_{k_t} p(s_{t,k_t}=s, X, d) \tag{15}$$

In Equation (15), $s_{t,kt}$ is a random variable indicating a subclass related to a sound source kt at the time t. In addition, X is a set of all sound feature amounts x at the time t. $p(s_{t,k}t=s,X,d)$ in Equation (15) can be calculated on the sound model stored by the sound model storage unit 25.

However, $p(s_{t,kt}=s,X,d)$ cannot be determined independently from not only the sound source $k_t$ but also other sound sources at the time t due to the characteristics of the Bayesian network.

Here, a specific calculation method of $p(s_{t,kt}=s,X,d)$ will be described. First, it is assumed that there are only two sound sources at the time t for a sake of simplicity, and a case in which sound sources $k_t$ and $k_t'$, sound feature amounts x and x' ($X=\{x,x'\}$), and sound source directions d and d' are given is considered.

In this case, a probability p(s,X,d) related to the subclass s of the sound source $k_t$ can be expressed as shown in the following Equation (16).

$$p(s, X, d)=\sum_{c,c'} p(d, d'\mid c, c')p(x\mid s)p(s\mid c)p(c)p(x'\mid c')p(c') \tag{16}$$

However, p(x'|c') in Equation (16) is defined as shown in the following Equation (17).

$$p(x'|s')=\Sigma_{s'}p(x'|s')p(s'|c')p(c') \tag{17}$$

When there are two or more sound sources, it is necessary to calculate a probability p(x|c) several times, and thus the sound model generation unit 24 may calculate a probability p(x|c) for all frames depending on each other in advance to create a table. As a result, it is possible to perform calculation at high speed. The sound model generation unit 24 may sequentially perform calculation without using the table.

Moreover, a probability p(s|x) is a multivariate Gaussian distribution for the subclass s. Thus, a probability other than p(s|x) is given by definition. In addition, parameters $\kappa_1$ and $\kappa_2$ of the von Mises distribution can also be determined using an EM algorithm.

Next, sound model generation processing in the present embodiment will be described.

Figure 4:
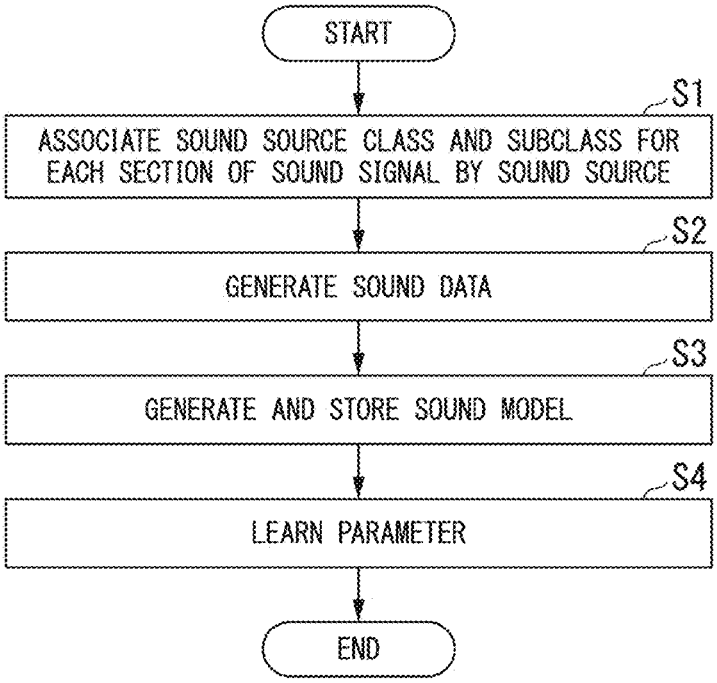
FIG. 4 is a flowchart of sound model generation processing according to the first embodiment.

FIG. 4 is a flowchart of the sound model generation processing in the present embodiment.

(Step S1) The sound model generation unit 24 associates (annotates) a sound source class and a subclass for each section of sound signals by sound source acquired in advance. The sound model generation unit 24 displays, for example, spectrograms of the sound signals by sound source on an image display unit. The sound model generation unit 24 associates a sound source class and a subclass with a separated sound on which sound source section detection, sound source localization processing, and sound source separation processing are performed for a sound signal output by the sound collecting unit 11 and the like.

(Step S2) The sound model generation unit 24 generates sound data on the basis of the sound signals by sound source associated with a sound source class and a subclass for each section. Specifically, the sound model generation unit 24 calculates a section rate for each sound source class as a probability p(c) for each sound source class c. In addition, the sound model generation unit 24 calculates a conditional probability p(d|c) of each direction d for each sound source class. In addition, the sound model generation unit 24 calculates a conditional probability p(x|c) of each sound feature amount x for each sound source class in the Bayesian network.

(Step S3) The sound model generation unit 24 generates a sound model by calculating a probability p(x,d,s,c) using each probability calculated by the Bayesian network expression as shown in FIG. 2, the Equation (8), and the step S2 as shown in FIG. 2. Subsequently, the sound model generation unit 24 stores the generated sound model in the sound model storage unit 25.

(Step S4) The sound model generation unit 24 introduces an EM algorithm into the sound model stored by the sound model storage unit 25 and learns parameters of the sound model. In the EM algorithm, unassociated data can be regarded as a missing value. For this reason, the sound model generation unit 24 performs semi-supervised learning by performing association on some of the sound signals acquired in advance. Moreover, the sound model generation unit 24 performs learning in consideration of mutual dependency between separated sounds by performing learning using a sound model. The parameters are the probability $p(s_t,k_t=s,X,d)$ in Equation (15), an expected value Ns, the probability p(s,X,d) of Equation (16), and the like.

Next, the sound source identification unit 26 will be described.

Figure 5:
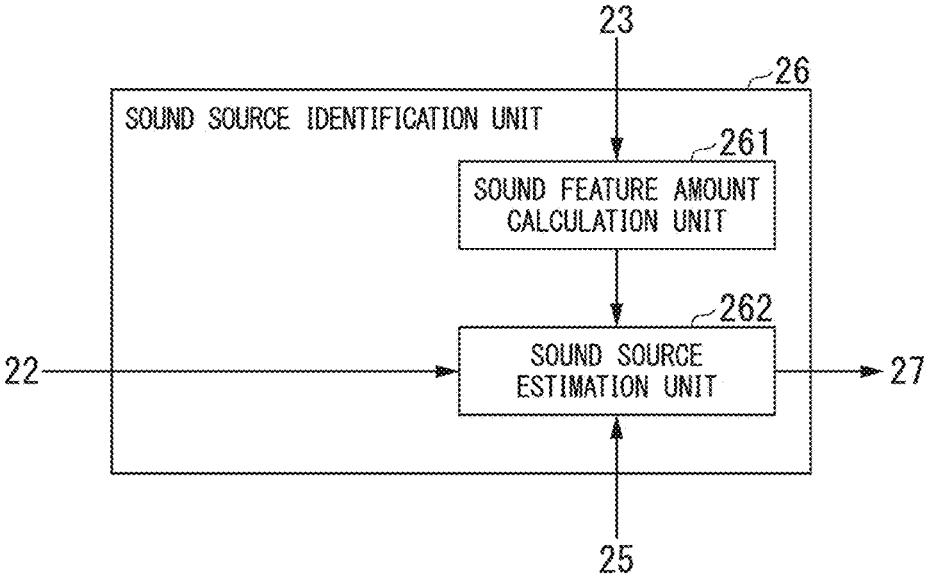
FIG. 5 is a block diagram which shows a configuration of a sound source identification unit according to the first embodiment.

FIG. 5 is a block diagram which shows a configuration of the sound source identification unit 26 according to the present embodiment. As shown in FIG. 5, the sound source identification unit 26 includes a sound feature amount calculation unit 261 and a sound source estimation unit 262.

The sound feature amount calculation unit 261 calculates a sound feature amount indicating a physical feature of the sound signals of each sound source output by the sound source separation unit 23 for each frame. The sound feature amount is, for example, a frequency spectrum. The sound feature amount calculation unit 261 may also calculate a principal component obtained by performing a Principal Component Analysis (PCA) on a frequency spectrum as a sound feature amount. In the principal component analysis, a component which contributes to a difference in sound source type is calculated as a principal component. For this reason, the principal component has lower dimension than the frequency spectrum. As a sound feature amount, a Mel Scale Log Spectrum (MSLS), a Mel Frequency Cepstrum Coefficients (MFCC), and the like are available. The sound feature amount calculation unit 261 outputs a calculated sound feature amount to the sound source estimation unit 262.

The sound source estimation unit 262 calculates the probability p(c), the probability p(d|c), and the probability p(x|c) with reference to information indicating a direction d output by the sound source localization unit 22, a sound feature amount x output by the sound feature amount calculation unit 261, and sound data (a class c and a subclass s) stored by the sound model storage unit 25 when identifying the acquired sound signals. Subsequently, the sound source estimation unit 262 estimates a sound source class using the probability p(c), the probability p(d|c), and the probability p(x|c) which have been calculated, and Equation (14). In other words, the sound source estimation unit 262 estimates a sound source class which has a highest value for Equation (14) as a sound source class of a sound source. The sound source estimation unit 262 generates information on a sound source type indicating a sound source class for each sound source and outputs the generated information on a sound source type to the output unit 27.

Next, the sound source identification processing according to the present embodiment will be described.

Figure 6:
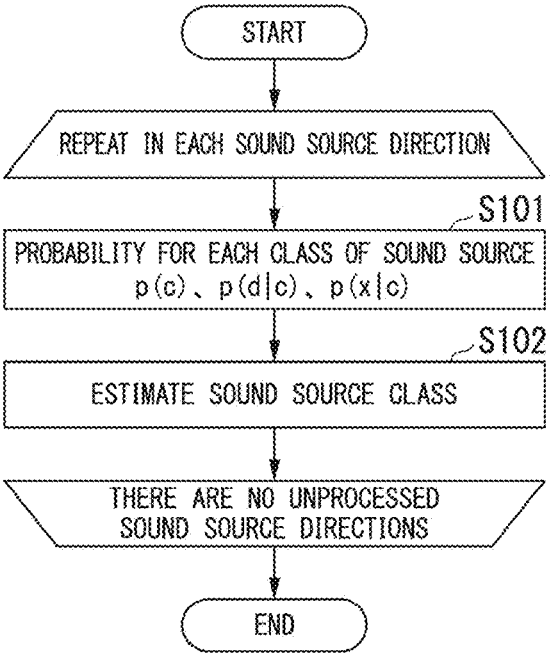
FIG. 6 is a flowchart of sound source identification processing according to the first embodiment.

FIG. 6 is a flowchart of sound source identification processing according to the first embodiment. The sound source estimation unit 262 repeats the processing shown in steps S101 and S102 in each sound source direction.

(Step S101) The sound source estimation unit 262 calculates the probability p(c), the probability p(d|c), and the probability p(x|c) with reference to the information indicating a direction d output by the sound source localization unit 22, the sound feature amount x output by the sound feature amount calculation unit 261, and the sound data (a class c and a subclass s) stored by the sound model storage unit 25.

(Step S102) The sound source estimation unit 262 estimates a sound source class using the probability p(c), the probability p(d|c), and the probability p(x|c) which have been calculated, and Equation (14). Thereafter, the sound source estimation unit 262 ends the processing of steps S101 and S102 when there are no sound source directions which have not been processed.

Next, voice processing according to the present embodiment will be described.

Figure 7:
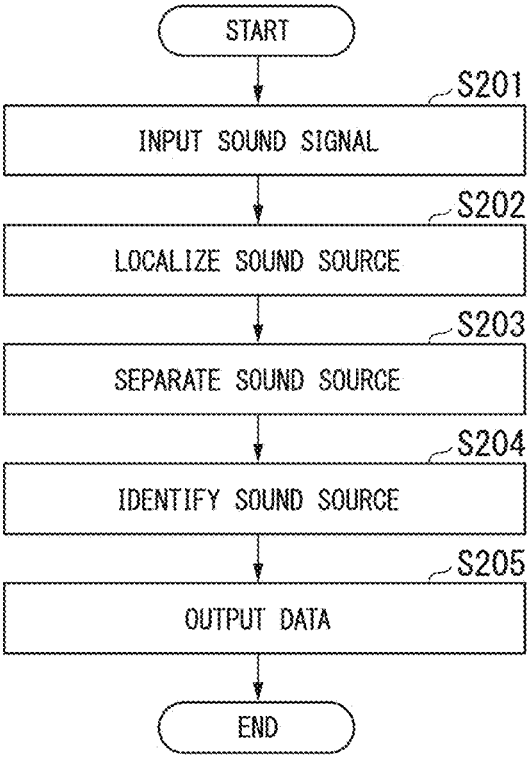
FIG. 7 is a flowchart of voice processing according to the first embodiment.

FIG. 7 is a flowchart of voice processing according to the present embodiment.

(Step S201) The acquisition unit 21 acquires, for example, sound signals of P channels output by the sound collecting unit 11 and outputs the acquired sound signals of P channels to the sound source localization unit 22.

(Step S202) The sound source localization unit 22 calculates a spatial spectrum for the sound signals of P channels output by the acquisition unit 21, and determines a sound source direction for each sound source on the basis of the calculated spatial spectrum (sound source localization). Subsequently, the sound source localization unit 22 outputs sound source direction information which indicates a sound source direction for each sound source and the sound signals of P channels to the sound source separation unit 23 and the sound source identification unit 26.

(Step S203) The sound source separation unit 23 separates the sound signals of P channels output by the sound source localization unit 22 into sound signals by sound source for each sound source on the basis of a sound source direction indicated by the sound source direction information. The sound source separation unit 23 outputs the separated sound signals by sound source to the sound source identification unit 26.

(Step S204) The sound source identification unit 26 performs the sound source identification processing shown in FIG. 6 on the sound source direction information output by the sound source localization unit 22 and the sound signals by sound source output by the sound source separation unit 23. The sound source identification unit 26 outputs information on a sound source type which indicates a class for each sound source determined by the sound source identification processing to the output unit 27.

(Step S205) The output unit 27 outputs the information on a sound source type output by the sound source identification unit 26 to an external device, for example, an image display device.

In the above, the sound processing apparatus 20 ends voice processing.

Next, an evaluation experiment using the sound processing apparatus 20 according to the present embodiment will be described.

In the evaluation experiment, eight channel sound signals recorded in a park of a city have been used. The recorded sound includes a bird's call as a sound source. The bird's call used in the evaluation is a song.

The type of sound source is determined for each section of a voice signal by sound source by operating the sound processing apparatus 20.

Figure 8:
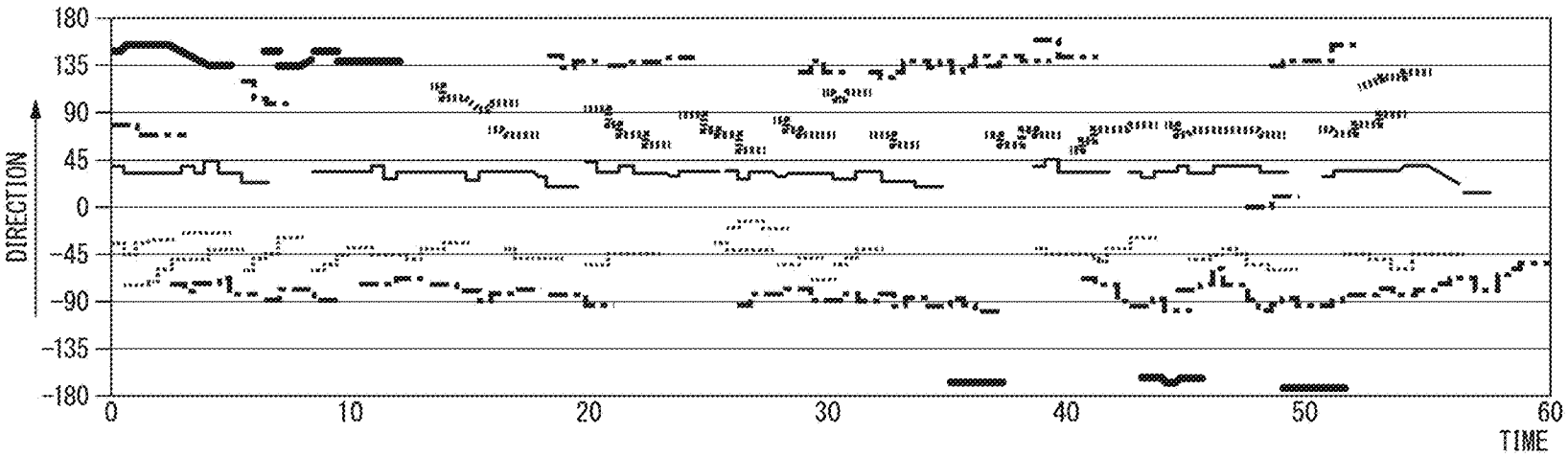
FIG. 8 is a diagram which shows an example of data used for evaluation.

FIG. 8 is a diagram which shows an example of data used for evaluation. In FIG. 8, a vertical axis represents the direction of sound source (−180° to +180°) and a horizontal axis represents time.

In FIG. 8, a sound source class is represented by a line type. A thick solid line, a thick dashed line, a thin solid line, a thin dashed line, and a one-point dashed line indicate the call of Narcissus flycatchers, the call of brown-eared bulbuls (A), the call of Japanese white-eyes, the call of brown-eared bulbuls (B), and other sound sources, respectively. The brown-eared bulbul (A) and the brown-eared bulbul (B) were different individuals and had different singing features, and thus were set as separate sound source classes.

Next, an example of a correct answer rate in an estimation result of a sound source class of the present embodiment and a comparative example will be described. For comparison, independently from sound source localization using the MUSIC method for voice signals by sound source obtained by sound source separation as a conventional method, the type of sound source for sound signals by sound source obtained by sound source separation using GHDSS was determined for each section using sound data. In addition, parameters $\kappa_1$ and $\kappa_2$ were set to 0.2, respectively. Moreover, the sound feature amount calculation unit 261 calculated one frame of a frequency spectrum with 40 step widths (every 2.5 ms) of a window width 80 from a separated sound of a digital signal sampled at 16 kHz as a sound feature amount. Then, the sound feature amount calculation unit 261 extracted a block of 100 frames with a step width of 10 frames, and used the block as a data set for evaluation by regarding the blocks as a 4100 dimensional vector and compressing it into 32 dimensions by principal component analysis. Moreover, the sound source identification unit 26 estimated a sound source class for each block and finally determined a sound source class of an event by majority decision for all blocks in the event.

Figure 9:
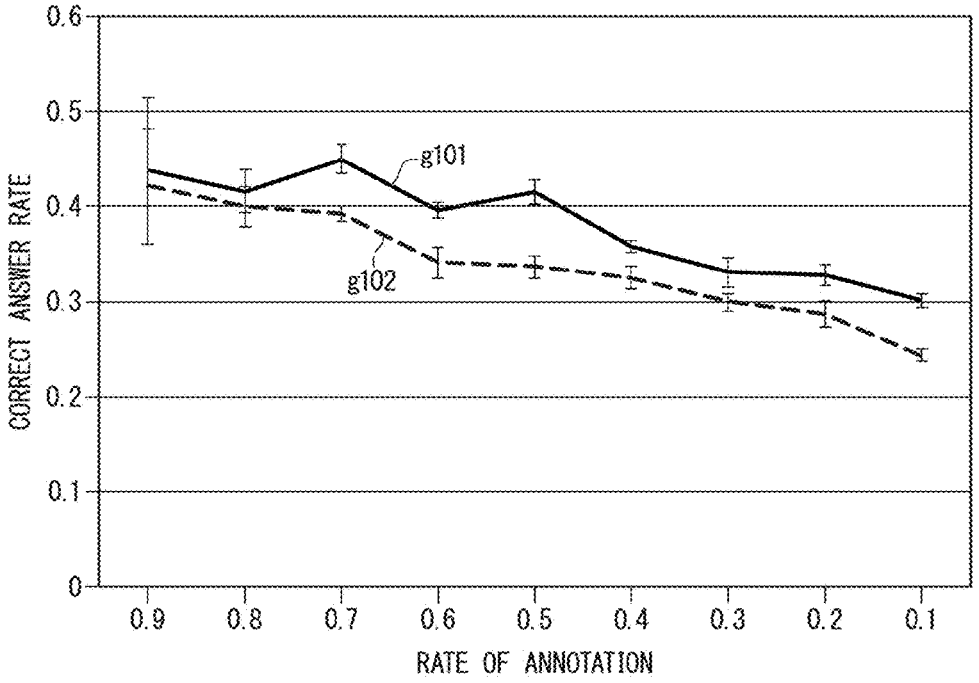
FIG. 9 is a diagram which shows a correct answer rate with respect to an annotation rate.
Figure 10:
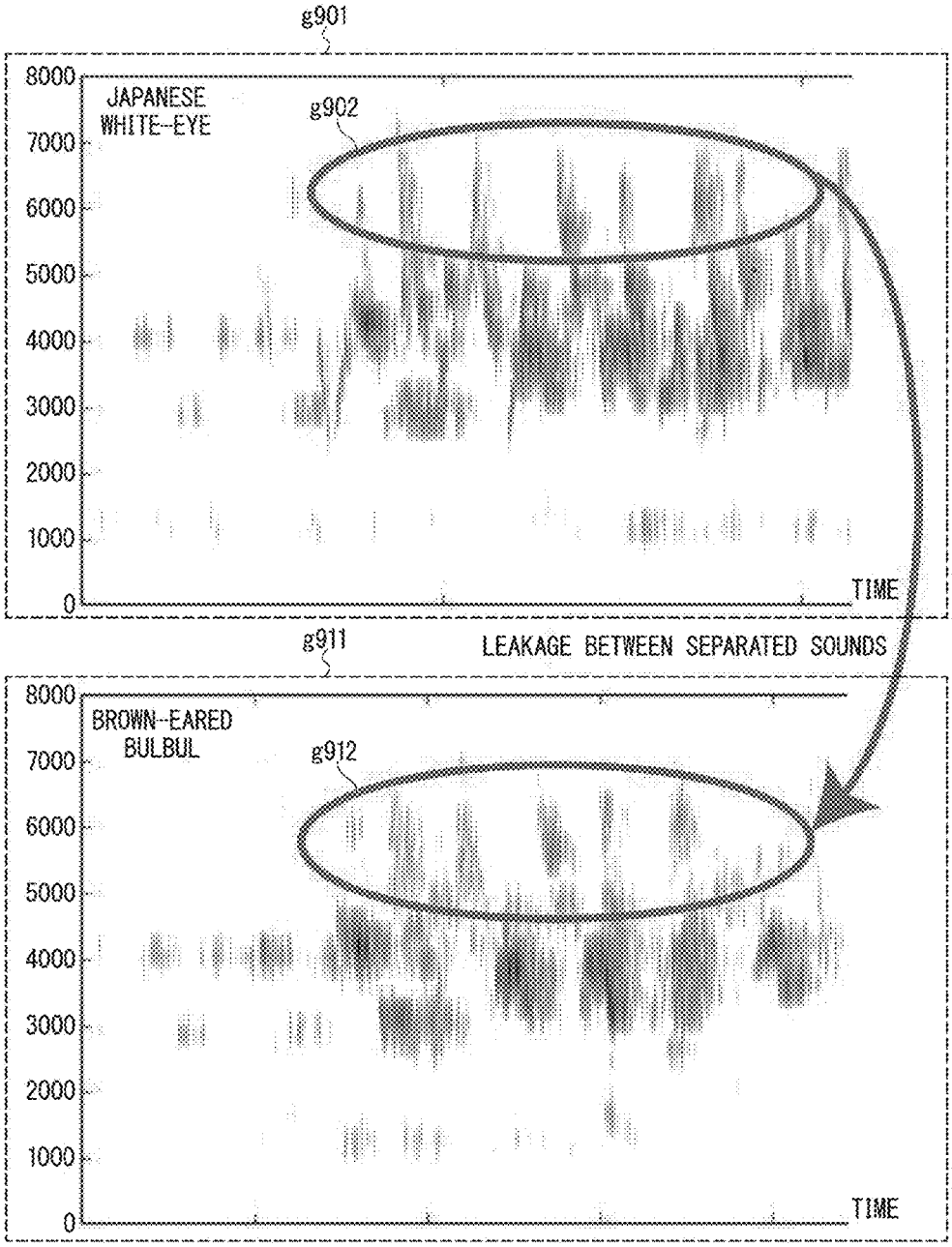
FIG. 10 is a diagram which shows an example of a result of sound source separation between calls of a Japanese white-eye and a brown-eared bulbul which are singing nearby at the same time according to the related art.

FIG. 9 is a diagram which indicates a correct answer rate with respect to the rate of annotation. In FIG. 9, the horizontal axis indicates the rate of annotation (0.9 to 0.1) and the vertical axis indicates a correct answer rate. In addition, a polygonal line g101 is an evaluation result of the present embodiment. The polygonal line g102 is an evaluation result of the comparative example.

As shown in FIG. 9, in all annotation rates, a method according to the present embodiment has a higher correct answer rate than in the comparative example.

As described above, a sound model is generated using localization information (direction information) of a sound source, and a sound source class is estimated using the sound model in the present embodiment. In addition, the Bayesian network which is a probabilistic model expression is used in the sound model in the present embodiment. As a result, according to the present embodiment, it is possible to effectively use information on proximity between sound sources and to improve accuracy in sound source identification by performing the sound source identification using a sound model including a dependence relationship between sound sources by a probabilistic model expression using a result of sound source localization.

In addition, since the Bayesian network is used for a sound model, it is possible to clarify the dependence relationship between sound sources in the present embodiment. Accordingly, the accuracy of sound source identification can be improved.

Moreover, a sound model is generated using the von Mises distribution in the present embodiment. As a result, according to the present embodiment, the direction of a sound source can be appropriately modeled.

As a result, according to the present embodiment, a sound source class is estimated using the sound model, and thus it is possible to accurately estimate a sound source class.

Furthermore, in the present embodiment, a result of separation performed by a sound source separation unit is used for the sound model, and thus it is possible to further improve the accuracy of sound source identification.

In addition, in the present embodiment, parameters of a sound model are learned by an EM algorithm using the generated sound model. As a result, according to the present embodiment, the EM algorithm is used, and thus it is possible to perform semi-supervised learning and to reduce an amount of work for performing annotation. Moreover, according to the present embodiment, it is possible to consider mutual dependency between separated sounds by performing learning using a sound model.

In the present embodiment, an example of generating a sound model is described using information on two sound sources, but the present embodiment is not limited thereto.

For example, when there are three sound sources and observation variables are sound source classes $c_1$ to $c_3$, the present embodiment is expressed by the Bayesian network using a subclass and a sound feature amount of each of these sound source classes.

In this case, in Equation (8) described above, when there are different sound source classes ($c_i \neq c_j$), Equation (12) of a probability $p(d_i, d_j | c_i \neq c_j)$ can be represented as shown in the following Equation (18).

$$\left.\begin{aligned} p(d_i, d_j \mid c_i \neq c_j) &= f(d_i - d_j + 2\pi/3; \kappa_2) \\ p(d_i, d_j \mid c_i \neq c_j) &= f(d_i - d_j + 4\pi/3; \kappa_2) \end{aligned}\right\} \quad (18)$$

In other words, as shown in Equation (18), when there are three sound sources having different sound source classes, a relationship in which directions of the sound sources are separated from each other by ($2\pi/3$) is a distant relationship.

Furthermore, when the number of sound sources is four, a relationship in which directions of the sound sources are separated from each other by ($2\pi/4$) is a distant relationship. Hereinafter, when the number of sound sources is K, a relationship in which directions of the sound sources are separated from each other by ($2\pi/K$) is a distant relationship.

Second Embodiment

In the first embodiment, an example in which the sound signal acquired by the acquisition unit 21 is the call of birds, in particular, a song is described, but the sound source class estimated by the sound processing apparatus 20 is not limited thereto. The sound signal for estimating a sound source class may be human utterances. In this case, one utterance is a sound source class and a syllable is a subclass.

A configuration of the sound processing apparatus 20 when a sound source class is estimated for human utterances is the same as that of the sound processing apparatus 20 of the first embodiment.

For example, there are cases in which a second speaker speaks near a first speaker at the same time. In such a case, even when the utterances of the two speakers are separated, the utterance of one speaker can be mixed with the separated sounds of another speaker in some cases. Even in such cases, since a sound source localization result is used and a sound model is generated using the sound processing apparatus 20, it is thereby possible to further improve a correct answer rate of a sound source class than in the related art.

In the present embodiment, the number of speakers in a vicinity is not limited to two, and the same effects can be obtained even when there are three or more speakers.

Third Embodiment

A sound signal acquired by the sound processing apparatus 20 may be a sound signal including human utterances. For example, when the acquired sound signal includes human utterances and a dog's call, the sound processing apparatus 20 may set a first sound source class to be a human and a second sound source class to be a dog. A configuration of the sound processing apparatus 20 in this case is the same as that of the sound processing apparatus 20 of the first embodiment.

In this manner, the sound signal acquired by the sound processing apparatus 20 may be at least one of a wild bird's call, a section of human speech, an animal's call, and the like, or a mixture of these.

In the first embodiment to the third embodiment described above, if the sound model storage unit 25 stores a sound model in advance, the sound processing apparatus 20 may not include the sound model generation unit 24. In addition, the generation processing of a sound model performed by the sound model generation unit 24 may also be performed by an external device of the sound processing apparatus 20, such as a computer. In addition, the sound model storage unit 25 may be, for example, on a cloud, or may be connected via a network.

In addition, the sound processing apparatus 20 may be configured to further include a sound collecting unit 11. The sound processing apparatus 20 may also include a storage unit configured to store the information on a sound source type generated by the sound source identification unit 26. In this case, the sound processing apparatus 20 may not include the output unit 27.

In the first embodiment to the third embodiment described above, an example of the Bayesian network expression as the type of a probabilistic model expression in a sound model has been described, but the present invention is not limited thereto. The sound model may represent a dependence relationship between sound sources using information on localized sound sources and use a graphical model using a probabilistic expression. As the graphical model, for example, a Markov random field, a factor graph, a chain graph, a conditional probability field, a restricted Boltzmann machine, a clique tree, an Ancestral graph, and the like may also be used instead of the Bayesian network.

The sound processing apparatus 20 described in the first embodiment to the third embodiment described above may be provided in, for example, a robot, a vehicle, a tablet terminal, a smart phone, a portable game machine, a household appliance, or the like.

A program for realizing a function of the sound processing apparatus 20 in the present invention is recorded in a computer readable recording medium, and the program recorded in this recording medium may be realized by being read and executed by a computer system. "Computer system" herein includes an OS or hardware such as peripheral devices. In addition, "computer system" also includes a WWW system having a homepage providing environment (or a display environment). Moreover, "computer readable recording medium" refers to a portable medium such as a flexible disk, a magneto-optical disk, a ROM, or CD-ROM, and a storage device such as a hard disk embedded in a computer system. Furthermore, "computer readable recording medium" includes those holding a program for a certain period of time such as a volatile memory (RAM) in a computer system serving as a server or a client when the program is transmitted via a network such as the Internet or a communication line such as a telephone line.

In addition, the program may be transmitted from a computer system storing this program in a storage device to another computer system via a transmission medium or by a transmission wave in the transmission medium. Here, "transmission medium" for transmitting a program refers to a medium having a function of transmitting information like a network (communication network) such as the Internet or a communication line such as a telephone line. Moreover, the program may be a program for realizing some of the functions described above. Furthermore, the program may be a so-called difference file (difference program) which can realize the functions described above by combining the functions with a program already recorded in a computer system.

What is claimed is:

1. A sound processing apparatus comprising:

an acquisition unit configured to acquire sound signals collected by a microphone array;

a sound source localization unit configured to determine a sound source direction on the basis of the sound signals acquired by the acquisition unit;

a sound source separation unit configured to separate the sound signals into sound signals by sound source on the basis of information of the sound source direction determined by the sound source localization unit; and a sound source identification unit configured to identify a type of sound source on the basis of the information of the sound source direction and the sound signals by sound source, wherein the sound source identification unit identifies the type of sound source by estimating a sound source class using the following sound model equation in a learned Gaussian Mixture Model, $$c^* = \underset{c}{\operatorname{argmax}} p(c \mid x, d) = \underset{c}{\operatorname{argmax}} p(x \mid c)p(d \mid c)p(c)$$

where x is a sound feature amount, c is the sound source class, d is the sound source direction, p(c) is a probability for each sound source class c, p(d|c) is a conditional probability of each sound source direction d for each sound source class c, and p(x|c) is a conditional probability of each sound feature amount x for each sound source class c, and wherein the sound source class is obtained by classifying one sound section according to the sound feature amount.

2. The sound processing apparatus according to claim 1, further comprising, the sound source separation unit configured to separate sound sources on the basis of a result of the sound source direction determined by the sound source localization unit, wherein parameters of the sound model equation are learned by an EM algorithm.

3. A sound processing method comprising:

an acquisition procedure of acquiring, by an acquisition unit, a sound signal collected by a microphone array;

a sound source localization procedure of determining, by a sound source localization unit, a sound source direction on the basis of a sound signal acquired in the acquisition procedure;

a sound source separation procedure of separating the sound signals into sound signals by sound source on the basis of information of the sound source direction determined in the sound source localization procedure; and a sound source identification procedure of identifying a type of sound source on the basis of the information of the sound source direction and the sound signals by sound source, wherein, in the sound source identification procedure, the type of sound source is identified by estimating a sound source class using the following sound model equation in a learned Gaussian Mixture Model, $$c^* = \underset{c}{\operatorname{argmax}} p(c \mid x, d) = \underset{c}{\operatorname{argmax}} p(x \mid c)p(d \mid c)p(c)$$

where x is a sound feature amount, c is the sound source class, d is the sound source direction, p(c) is a probability for each sound source class c, p(d|c) is a conditional probability of each sound source direction d for each sound source class c, and p(x|c) is a conditional probability of each sound feature amount x for each sound source class c, and wherein the sound source class is obtained by classifying one sound section according to the sound feature amount.

* * * * *